US005423310A

United States Patent [19]

Hudson et al.

[11] Patent Number: 5,423,310

[45] Date of Patent: Jun. 13, 1995

[54] GAS LOG BURNER ASSEMBLY

[75] Inventors: Lewis W. Hudson; Ryan E. Rose; Richard A. Prasco, all of Lisbon, Ohio

[73] Assignee: R & R Holding, Inc., Columbiana, Ohio

[21] Appl. No.: 269,521

[22] Filed: Jul. 1, 1994

[51] Int. Cl.[6] ..... F24C 3/00

[52] U.S. Cl. ..... 126/512; 126/92 R; 431/125

[58] Field of Search ..... 126/512, 92 R, 92 AC; 431/125

[56] References Cited

U.S. PATENT DOCUMENTS

| | | | |
|---|---|---|---|
| 1,239,346 | 9/1917 | Brown . | |
| 2,084,566 | 6/1937 | Warfield | 126/92 |
| 3,181,590 | 5/1965 | Dupler | 158/100 |
| 4,838,240 | 6/1989 | Rieger | 126/92 R |
| 5,000,162 | 3/1991 | Shimek et al. | 126/512 |
| 5,026,271 | 6/1991 | Orlov et al. | 431/125 |
| 5,263,852 | 11/1993 | Beck | 431/125 |

*Primary Examiner*—Carroll B. Dority
*Attorney, Agent, or Firm*—Michael Sand Co.

[57] ABSTRACT

A gas log burner assembly produces a glowing effect by providing a cover wall over the heretofore open top of a usual burner pan. A gas supply pipe is buried within a non-combustible porous medium, such as sand, within a gas distribution chamber formed by the walls of the burner pan. The cover wall has a series of gas outlet holes arranged across the plate including an elongated slot at an upper rear edge thereof. An artificial log is mounted on the top and rear of the burner pan and extends along the elongated slot and has a rough textured concave front surface. The slot and holes in the top cover wall and the concave surface of the log control and direct the flow of gas from the supply pipe into a combustion area formed in front of the log to provide controlled combustion of the gas within and adjacent to the concave front surface of the log to provide a glowing effect to the rough textured surface thereof. A grate is mounted immediately adjacent and above the top cover wall and supports a plurality of other artificial logs adjacent the combustion area.

20 Claims, 3 Drawing Sheets

GAS LOG BURNER ASSEMBLY

BACKGROUND OF THE INVENTION

1. Technical Field

The invention relates to fireplace gas burners, and more particularly to a gas burner assembly with associated artificial gas logs which provide a glowing effect similar to that produced by burning natural wood logs in the fireplace.

2. Background Information

Artificial gas logs for use in a fireplace are gaining popularity due to their ease of use and elimination of harmful toxins which may be released into the air when burning natural wood, coal or other fuels. Likewise, such artificial logs are permanent and reusable, and over a period of time are considerably less expensive than natural wood logs or other types of consumable fuel.

However, a common drawback of such artificial gas logs is the lack of a burning pattern simulating that of a natural wood fire, which is desired by many people. It is desirable to produce a glowing effect similar to that produced by a natural wood fire after the flames have died down, which heretofore has been difficult to produce with artificial gas logs.

One common type of gas log burner assembly presently in use today consists of an open-top burner pan which is filled with a noncombustible porous medium, such as sand, vermiculite, ceramic particles, or the like, which covers a perforated gas supply pipe. In these prior art burner pans, the gas is discharged from the supply pipe and filters in a random fashion through the porous medium to a combustion area above the medium, which is usually formed by a plurality of artificial gas logs supported on a grate above the porous medium.

It has been found that due to the random uncontrolled movement of the gas through the porous medium, it is difficult to provide a consistent combustion of the gas adjacent the artificial gas logs in order to provide the desired glowing effect of natural wood logs.

Therefore, it is desirable to provide a gas log burner pan assembly which provides a glowing effect closely simulating that of natural wood fires to the artificial logs mounted on the burner assembly.

SUMMARY OF THE INVENTION

Objectives of the invention include providing a gas burner assembly which produces a close simulation of the glowing pattern that is produced by a natural wood log fire.

Another objective of the invention is to provide such a gas log burner assembly which controls the flow of gas into a combustion area located closely adjacent the artificial gas logs in order to achieve the desired combustion at a specific location, which will then provide a glowing effect to the artificial gas logs mounted on a grate closely adjacent to the combustion area.

A still further objective of the invention is to provide such a gas log burner assembly in which a usual burner pan has a top cover wall formed with a plurality of openings which control the flow of gas from the combustion chamber located immediately below, which in combination with an artificial gas log or logs produces the sought-after glow effect of a natural wood log fire.

A further objective of the invention is to provide such a gas log burner assembly having a main artificial gas log which extends across the back of the burner pan, and which is formed with a concave front surface having a rough texture which, in addition to directing the flow of gas into a combustion area in front of the log, will provide the glowing effect due to the roughened textured surface thereof.

These objectives and advantages are obtained by the gas log burner assembly of the present invention, the general nature of which may be stated as including a burner pan having a bottom wall, a rear wall, a spaced pair of end walls, and an upwardly rearwardly extending inclined top cover wall forming an interior gas distribution chamber; a gas supply pipe extending within the gas distribution chamber and having a plurality of spaced gas outlet openings for emitting gas into .said chamber; a rear artificial log mounted adjacent to and extending along an upper rear portion of the burner pan; a grate located in front of the said rear artificial log and above the top cover wall for supporting a plurality of other artificial logs to form a combustion area in front of said rear log; and a plurality of holes formed in the top cover wall beneath the grate to direct and control the flow of gas from within the gas distribution chamber into the combustion area.

BRIEF DESCRIPTION OF THE DRAWINGS

A preferred embodiment of the invention, illustrative of the best mode in which applicants have contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENT

Figure 5:
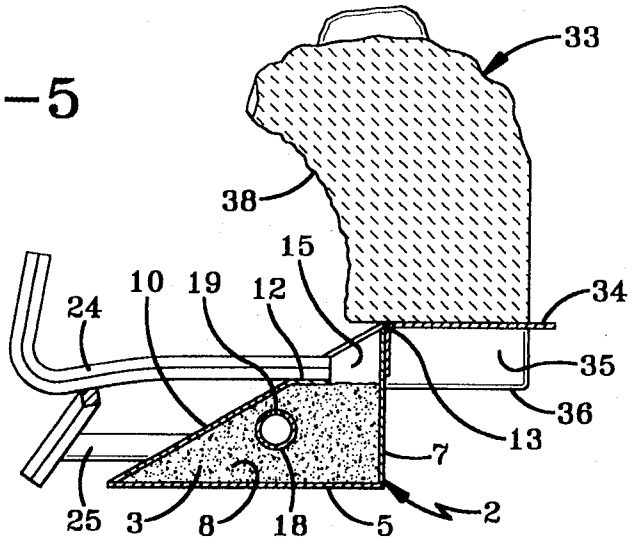
FIG. 5 is a sectional view taken on line 5—5, FIG. 1.
Figure 3:
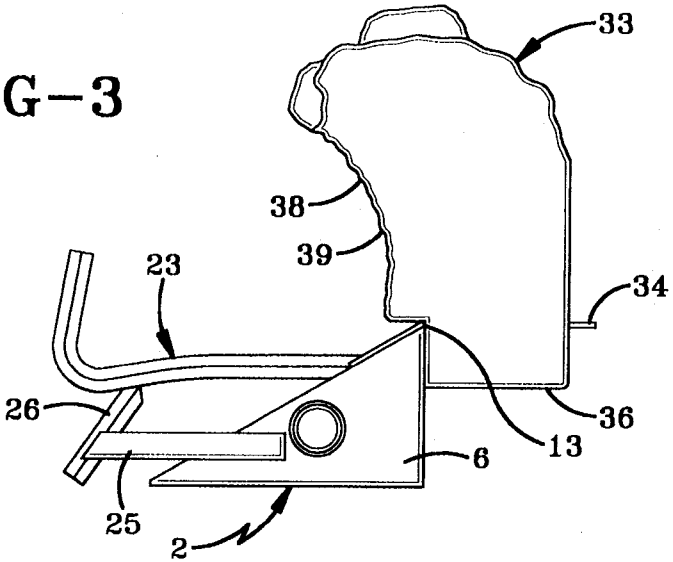
FIG. 3 is a right side elevational view of FIG. 1.
Figure 4:
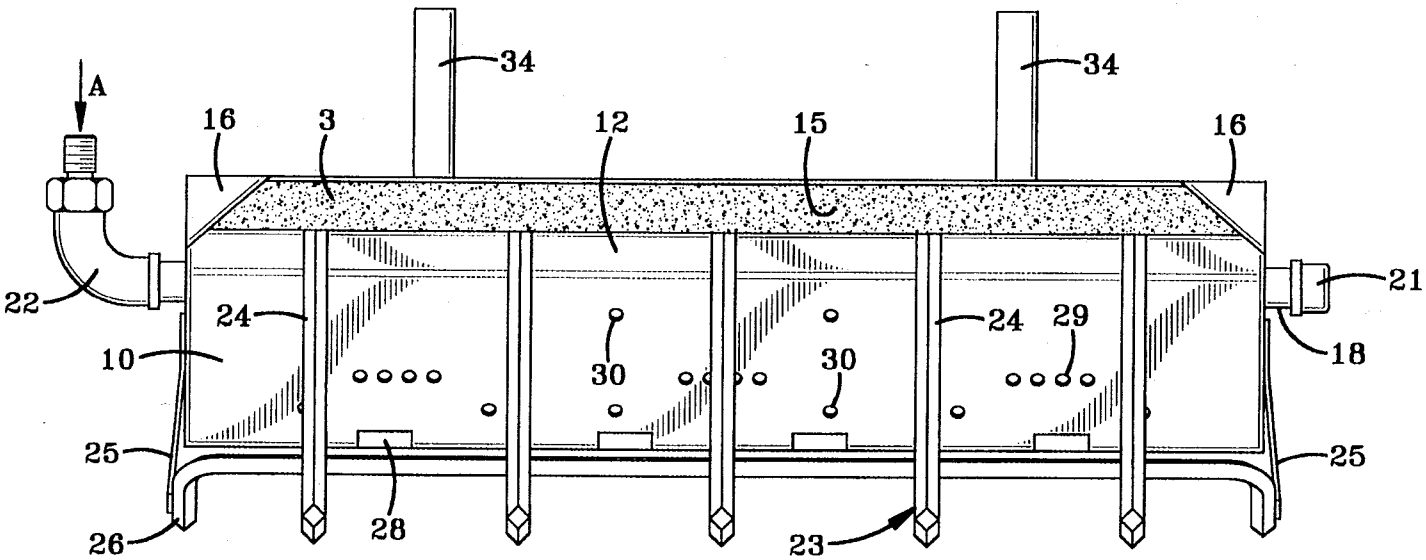
FIG. 4 is a top plan view of the burner assembly of FIG. 1 with the artificial gas log removed therefrom.
Figure 6:
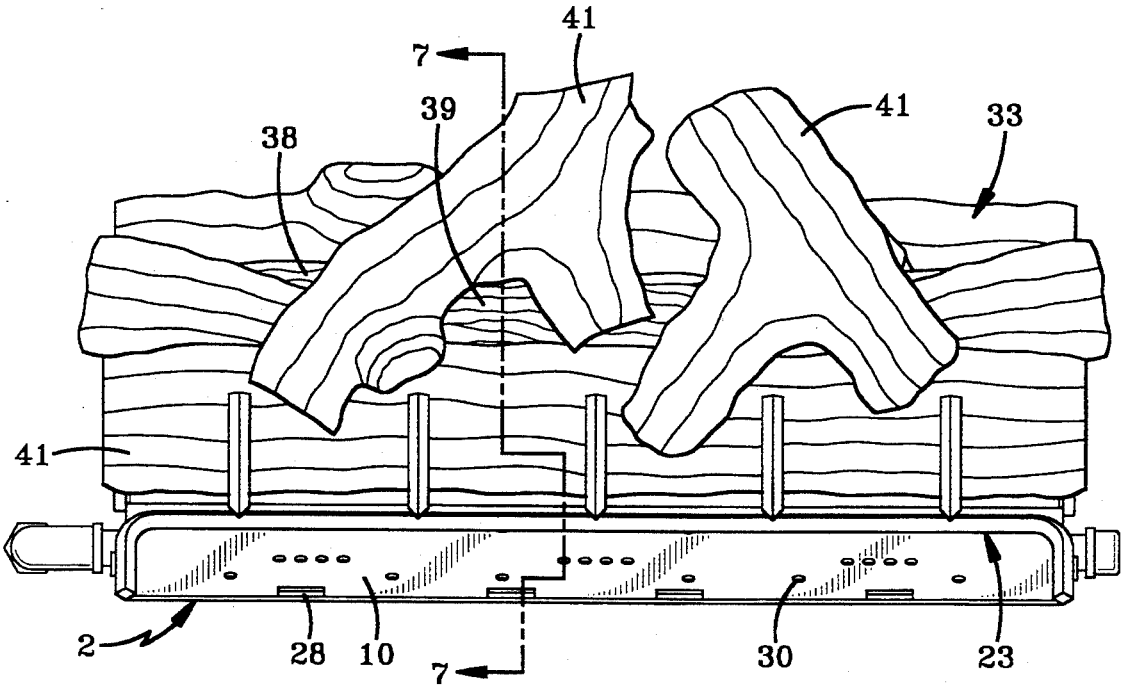
FIG. 6 is a front elevational view similar to FIG. 1, with additional artificial gas logs mounted thereon.

The improved burner assembly of the present invention is indicated generally at 1, and includes as a main component a burner pan, also referred to as a pan burner in the relevant industry, indicated generally at 2, which contains a supply of a usual noncombustible porous medium 3, such as sand, vermiculite, ceramic particles, or the like (FIGS. 4 and 5). Pan 2 includes a bottom wall 5, a pair of spaced end walls 6, and a rear wall 7, which form a generally triangular configuration, such as shown in FIGS. 3 and 5, and define a gas distribution chamber 8.

In accordance with one of the features of the invention, an inclined upwardly rearwardly extending front cover wall 10 encloses the heretofore open top of the burner pan. Wall 10 extends from adjacent a front edge 11 of bottom wall 5 upwardly at an inclined angle of approximately 30° terminating in a horizontal inwardly extending top shelf 12, which is spaced below top edge 13 of rear wall 7 (FIG. 5).

In accordance with another feature of the invention, shelf 12 forms an elongated slot 15 between front wall 10 and back wall 7 which extends generally throughout the longitudinal length of burner pan 2, as shown in FIG. 4, except for two triangular corner plates 16 which extend between the junction of the top corner or apex of end walls 6 and rear wall 7.

A usual gas supply pipe 18 extends through a pair of aligned holes formed in end Walls 6, and is provided with a plurality of equally spaced openings 19 for discharging gas into the bed of porous material 3 in gas distribution chamber 8. Preferably, pipe 18 extends outwardly beyond both end walls, with one open end thereof being closed by an end cap 21, and the other end having an elbow 22 or similar coupling connected thereto for connecting pipe 18 to a source of combustion gas, such as indicated by arrow A (FIG. 4). By extending pipe 18 through both end walls, with both ends of the pipe being open, it enables either end to be closed by end cap 21, with the other end then being connected to a supply of gas, depending upon the location of the incoming gas supply line.

A grate, indicated generally at 23, is formed with a plurality of horizontally extending and spaced grate bars 24. Grate 23 is mounted on burner pan 2, preferably by a pair of end brackets 25 which extend between a downwardly projecting leg 26 of grate 23 and end walls 6.

In further accordance with the invention, a plurality of openings are formed in top cover wall 10, and are spaced therealong, such as shown particularly in FIG. 4. In the preferred embodiment, the openings consist of a plurality of slots 28 formed at the juncture of bottom wall 5 and top wall 10, and a horizontal row of individual holes 29 which are arranged in a series or groups of such holes, which groups are then spaced generally equally from each other. As shown in FIG. 4, three such groups each consisting of four holes, are provided and extend horizontally along wall 10. In addition to slots 28 and holes 29, additional holes 30 are formed in wall 10 and are generally equally spaced from each other and form two horizontal rows of such holes on opposite sides of the group of holes 29. It has been found that the particular arrangement of holes and slots as shown in FIG. 4 provides a good glow effect to the artificial logs for the reasons discussed more fully below. However, other arrangements of holes and slots can be utilized in front cover wall 10 without affecting the concept of the invention.

Figure 1:
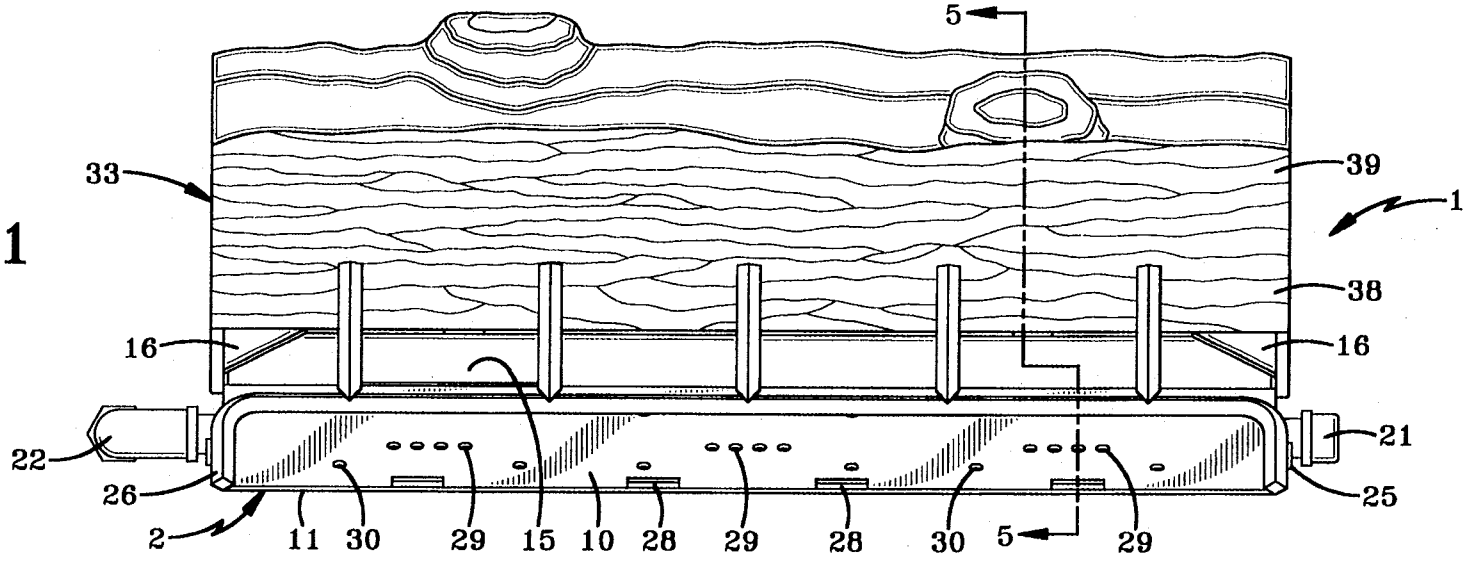
FIG. 1 is a front elevational view of the improved gas log burner assembly of the present invention.
Figure 2:
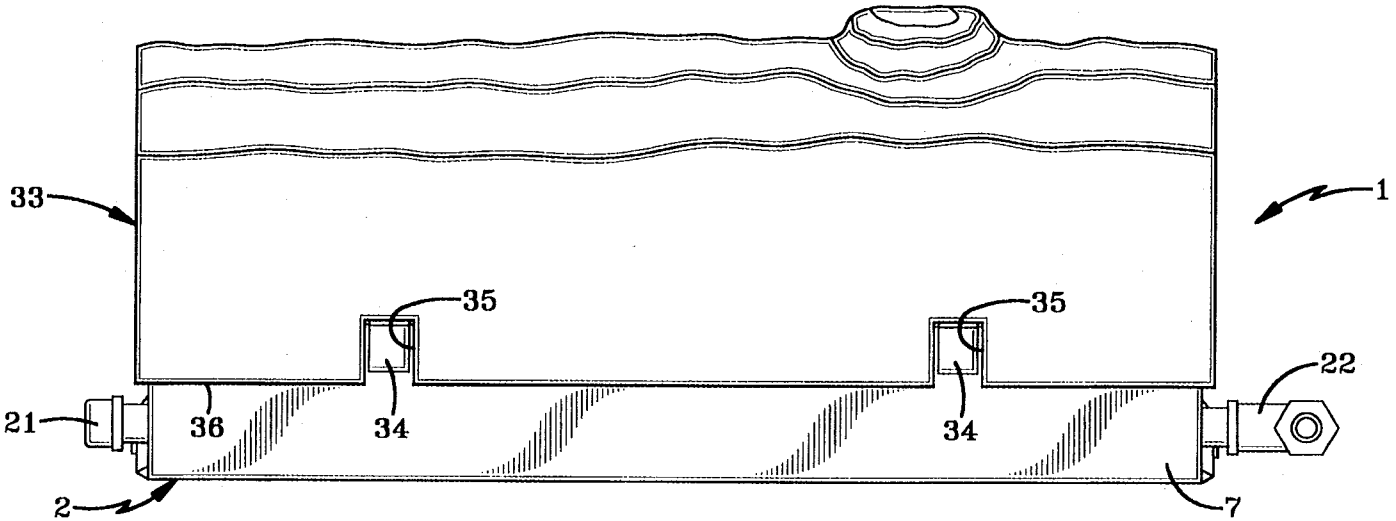
FIG. 2 is a rear elevational view of FIG. 1.

A rear artificial gas log, indicated generally at 33, is mounted on a pair of spaced horizontally extending brackets 34 which are attached to rear wall 7 and extend outwardly therefrom, as shown particularly in FIGS. 4 and 5. Gas log 33, which is of a usual construction formed of a refractory-type material, preferably is mounted on brackets 34 by forming a pair of elongated slots 35 in a horizontal bottom surface 36 thereof. Slots 35 enable log 33 to be placed at the correct position on burner pan 2 by slidably mounting brackets 34 in the slots, as shown particularly in FIGS. 2 and 5, when the burner assembly is being installed by a purchaser thereof.

Figure 7:
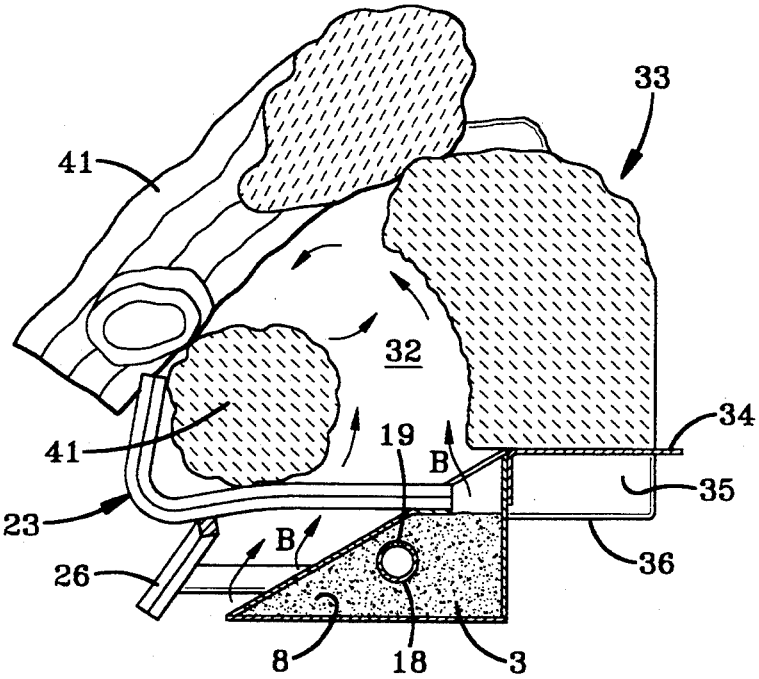
FIG. 7 is a sectional view taken on line 7—7, FIG. 6.

Front surface 38 of log 33 is concave, extending between top and bottom, and is provided with a rough texture 39 which provides a plurality of projections and depressions therein. This textured surface, in combination with the controlled combustion of the gas adjacent thereto, provides a glow to the burner assembly. It has been found that by controlling the flow pattern and distribution of the gas as it leaves the bed of porous material 3 (arrows B, FIG. 7) by the use of the specially arranged pattern of holes and slots in front cover wall 10, the gas will enter the combustion area 32, as shown in FIG. 7, in a concentrated amount. This distribution and collection of the gas is further assisted by the concave front surface 38 of log 33. The combustion area 32 is located immediately adjacent front concave surface 38 of log 33 and, it has been found, will produce the desired flame and resulting glow to the irregular textured surface 39 of log 33.

Preferably, a plurality of additional artificial gas logs 41 will be supported on grate 23 in front of log 33, and surrounds combustion area 32, which further maintains the heat and flames within this combustion area in front of concave surface 38 of log 33. This controlled movement and pattern of the combustion gas, in contrast to the heretofore random movement of the gas leaving the porous medium, and its concentration in the combustion area among the artificial gas logs, provides for the desired concentration of heat adjacent the concave front surface 38 of rear log 33, which when combined with the rough textured surface thereof, provides a constant glow thereto. It also will provide some glow to the adjacent surfaces of the other artificial gas logs 41 which surround the combustion area. Furthermore, it is believed that by placing grate 23 closely adjacent or in alignment with the top surface of the bed of porous medium 3, also contributes to the concentration of the heat and the controlled movement of the gas into the combustion area.

Accordingly, the gas log burner assembly is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved gas log burner assembly is constructed and used, the characteristics of the construction, and the advantageous, new and useful results obtained; the new and useful structures, devices, elements, arrangements, parts and combinations, are set forth in the appended claims.

We claim:

1. A gas log burner assembly including a burner pan having a bottom wall, a rear wall, a spaced pair of end walls, and an upwardly rearwardly extending inclined top cover wall forming an interior gas distribution chamber;

a gas supply pipe extending within the gas distribution chamber and having a plurality of spaced gas outlet openings for emitting gas into said chamber;

a rear artificial log mounted adjacent to and extending along an upper rear portion of the burner pan;

a grate located in front of the said rear artificial log and above the top cover wall for supporting a plurality of other artificial logs to form a combustion area in front of said rear log; and a plurality of holes formed in the top cover wall beneath the grate to direct and control the flow of gas from within the gas distribution chamber into the combustion area.

2. The burner assembly defined in claim 1 including bracket means for mounting the rear artificial log along the upper rear portion of the burner pan.

3. The burner assembly defined in claim 2 in which the bracket means includes at least a pair of brackets extending rearwardly from the rear wall of the burner pan; and in which opening means is formed in the rear artificial log for receiving the brackets therein for mounting said rear log on the burner pan.

4. The burner assembly defined in claim 1 in which the rear artificial log is formed with a concave front surface; and in which said concave surface is textured to provide an irregular pattern of projections to provide a glowing effect thereto when combustion occurs in the combustion area.

5. The burner assembly defined in claim 1 in which a porous non-combustible medium is contained in the gas distribution chamber and covers the gas supply pipe.

6. The burner assembly defined in claim 5 in which the porous medium is selected from the group of sand, vermiculite and a granular ceramic.

7. The burner assembly defined in claim 5 in which the grate includes a plurality of spaced bars for supporting said other artificial logs; and in which said bars are located at a height generally aligned with the height of the porous medium.

8. The burner assembly defined in claim 7 including attachment means for attaching the grate to the burner pan.

9. The burner assembly defined in claim 8 in which the attachment means includes a pair of brackets extending between and connected to the grate and to the end walls of the burner pan.

10. The burner assembly defined in claim 1 in which the gas outlet openings are spaced generally uniformly along the gas supply pipe throughout the gas distribution chamber.

11. The burner assembly defined in claim 1 in which the holes formed in the top cover wall include an elongated slot extending along a top portion of the burner pan immediately adjacent the rear log.

12. The burner assembly defined in claim 11 in which the top cover wall holes further include a plurality of spaced slots formed adjacent the junction of a bottom edge of the cover wall with a front edge of the bottom wall of the burner pan.

13. The burner assembly defined in claim 11 in which the said rear artificial log has a bottom wall; and in which said bottom wall extends forwardly from the rear wall of the burner pan and immediately above the elongated slot.

14. The burner assembly defined in claim 13 in which a pair of spaced slots are formed in the bottom wall of the said rear artificial log; and in which a pair of spaced brackets extend rearwardly from the rear wall of the burner pan and are received within the spaced slots for mounting said rear log on the burner pan.

15. The burner assembly defined in claim 11 in which the top cover wall terminates in a horizontal shelf extending along the elongated slot; and in which the grate includes a plurality of spaced bars; and in which inner ends of the spaced bars extend along said shelf.

16. The burner assembly defined in claim 1 in which the gas supply pipe extends through aligned openings formed in the end walls of the burner pan and completely through the gas distribution chamber; in which said supply pipe is open at both ends; and in which one of said open ends of the gas supply pipe is closed by an end cap and the other end is adapted to be connected to a source of gas.

17. The burner assembly defined in claim 1 in which the top cover plate extends at an angle of approximately 30° with respect to the bottom wall of the burner pan.

18. The burner assembly defined in claim 1 in which the holes formed in the top cover wall includes a horizontal row of holes formed by a plurality of separate groups of closely spaced horizontally aligned holes; and in which a plurality of generally equally spaced individual holes form two other rows of such holes on opposite sides of said row of separate group holes.

19. The burner assembly defined in claim 1 in which the burner pan includes corner plates located at the junction of the end walls with the rear wall.

20. A burner pan for a gas log burner assembly including:

a plurality of walls forming an interior gas distribution chamber, said walls including a top wall extending over said chamber;

a gas supply pipe extending within the gas distribution chamber and having at least one gas outlet opening for emitting gas into said chamber;

a rear artificial log mounted adjacent to and extending along an upper rear portion of the burner pan;

a grate located in front of the said artificial log and above the top wall for supporting a plurality of other artificial logs to form a combustion area in front of said rear log; and a plurality of holes formed in the top cover wall beneath the grate to direct and control the flow of gas from within the gas distribution chamber into the combustion area to provide a glow effect to a front surface of said artificial log.

* * * * *